US005407206A

United States Patent [19]

Cohen

[11] Patent Number: 5,407,206

[45] Date of Patent: Apr. 18, 1995

[54] CRIBBAGE GAME APPARATUS

[76] Inventor: Gene D. Cohen, 1915 Biltmore St. NW, Washington, D.C. 20009

[21] Appl. No.: 208,271

[22] Filed: Mar. 10, 1994

[51] Int. Cl.[6] ..... A63F 3/00

[52] U.S. Cl. ..... 273/249; 273/285; 273/288; 273/148 A; 273/282.1; 235/90

[58] Field of Search ..... 273/242, 248, 249, 287, 273/282.1, 243, 288, 148 A, 285, 304; 235/90

[56] References Cited

U.S. PATENT DOCUMENTS

| | | | |
|---|---|---|---|
| D. 138,400 | 8/1944 | Roh | 235/90 |
| D. 238,957 | 2/1976 | Johnson | 235/90 |
| D. 285,539 | 9/1986 | Fudro | 235/90 |
| 2,244,921 | 6/1921 | Roth | 273/288 |
| 2,288,671 | 7/1942 | Batchelder | 273/148 A |
| 2,491,262 | 12/1949 | Gunther | 235/90 |
| 2,605,966 | 8/1952 | Stackhouse | 235/90 |
| 3,266,724 | 8/1966 | Johnson | 235/90 |
| 4,854,586 | 8/1989 | Morse | 273/249 |
| 4,984,808 | 1/1991 | Young | 273/285 |
| 5,126,717 | 6/1992 | Renaud et al. | 273/237 |

FOREIGN PATENT DOCUMENTS

| | | | |
|---|---|---|---|
| 2008955 | 6/1979 | United Kingdom | 273/282.1 |
| 2173406 | 10/1986 | United Kingdom | 273/237 |
| 2201896 | 9/1988 | United Kingdom | 273/243 |

OTHER PUBLICATIONS

World Wide Games catalog "Cribbage Board", Holiday Season 1988, p. 8, Colchester, Conn. 06415.

*Primary Examiner*—Benjamin H. Layno
*Attorney, Agent, or Firm*—Richard C. Litman

[57] ABSTRACT

An improved cribbage game apparatus includes a cribbage score board having a single scoring path for each player in order to obviate the need to repeat the counting or scoring lap and thus reducing confusion as to the laps completed. The board is larger than standard and the opponents' pegging or scoring paths are widely separated for further ease of use. The board folds for ease of storage, and includes separate storage space therein for each of the scoring pegs and at least one deck of cards when folded. The pegs are symmetrical to provide for ease of manipulation, and are differentiated by color and/or shape for each player for further ease of use. The board and pegs may be formed with differently shaped holes and peg ends for each player, thus precluding placement of one player's peg in another player's board path. The above cribbage game apparatus provides for ease of manipulation and scoring by the elderly and/or impaired, enabling them to continue to enjoy the game and providing mental stimulation for such players playing the game of cribbage.

17 Claims, 3 Drawing Sheets

10
52
56
60
68f
66b
66d
64
68d
50
58
58
66a
68e
68c
54
66c
64
62
68b
66f
62
62
60
66e
68a

CRIBBAGE GAME APPARATUS

FIELD OF THE INVENTION

The present invention relates generally to scoring devices for card games, and more specifically to a cribbage game apparatus comprising a board and pegs specifically formed to provide for ease of use for the elderly and/or impaired.

BACKGROUND OF THE INVENTION

Games requiring primarily mental skills are extremely popular pastimes for the elderly and/or physically impaired. Such persons generally do not have the capability for strenuous physical activities, but games requiring at least some mental activity are quite valuable in maintaining the alertness of such individuals. Many, if not most, individuals have learned the elements of at least a few card games during their lives, and continue to play such card games after retirement or during recovery from injury or illness due to the time available and need for mental stimulation.

One relatively popular card game is cribbage. However, cribbage differs from most other card games in that it requires a scoreboard with a series of holes defining the accrued point count for the players, and a plurality of pegs positionable in the holes of the cribbage scoreboard. Most such cribbage boards and pegs are relatively small and uniformly finished for compact storage and consistency of appearance. Such cribbage boards provide some utility, but may be difficult for an elderly or impaired person to use, due to a lack of visual acuity, fine motor skills, etc. In fact, many such cribbage boards are sufficiently small that the scoring marker pegs are formed of match sticks or toothpicks.

Moreover, the standard cribbage board requires two laps of the scoring track to complete a game. Historically the game was originally developed to require a total of 61 points to complete a game. However, as the game developed, the required winning score was essentially doubled to 121 points. Yet the cribbage board which was developed for Scoring remained unchanged, with two rows of 30 holes or places totaling 60 places for each player (plus the single winning 121st hole or place for each player). The result is a need to complete two rounds or laps of the scoring track or path in order to win a game. While many impaired persons have excellent long term memories and are quite capable of remembering the rules to a card game learned long ago, they may have difficulty with short term memory tasks such as recalling the number of laps of the cribbage board scoring track they have completed. Such a situation is frustrating to say the least for those involved, and can be alleviated to a great extent with the proper equipment.

The need arises for a cribbage game apparatus comprising a board having well marked and spaced apart single peg scoring paths or tracks, and scoring pegs providing for distinctive feel and color for each player. The resulting size of the board should provide for storage space not only for the scoring pegs, but also for at least one deck of cards. The board may be folded when not in use in order to conserve storage space.

DESCRIPTION OF THE PRIOR ART

U.S. Pat. No. 2,491,262 issued to Fred J. Gunther on Dec. 13, 1949 discloses a Scoring Device For Games comprising a cribbage board in which each scoring lane is divided into six segments of five places each. Each of the segments is sloped, in order to indicate the direction of advancement of the scoring pegs when scoring. The pegs appear to be identical, with the scoring holes or places and tracks or lanes relatively closely spaced with no differentiation between opponents' tracks. The only advantage of the Gunther cribbage board is the sloped segments to indicate the direction of travel; the Gunther board fails to address any of the other problems addressed by the present cribbage apparatus.

U.S. Pat. No. 2,605,966 issued to David L. Stackhouse on Aug. 5, 1952 discloses a Cribbage Board having a spring biased internal track for each first scoring track for each player. The internal track is held in position by the scoring peg(s) so the peg holes are in registry. However, when all pegs are removed from the first scoring track, the internal track shifts due to the spring, to effectively cause the peg holes along the first track to have a shallower depth. The pegs must then be inverted, with a second, shorter end being used for scoring the second round of the first track of the board. The Stackhouse board responds to the need for defining which round of the board is being scored, but requires asymmetrically shaped pegs in order to do so. The present board uses a single, longer track for each player and symmetrically shaped pegs, which require no special handling to place a specific end of the peg into a scoring position hole, according to the number of rounds of the board.

U.S. Pat. No. 3,266,724 issued to William J. Johnson on Aug. 16, 1966 discloses an Automatic Cribbage Board in which each of the tracks or streets is upwardly spring biased and includes a plurality of adjustable pegs permanently secured therein. The pegs are individually pushed downward as scoring progresses, to indicate the score to that point. When scoring along a given track is completed, the track is pushed downward, which causes the bottoms of the pegs to be pushed upward to their original positions. The device serves to preclude loss of the individual pegs, but does nothing to aid players in determining which round of play is being accomplished. The single round playing board of the present invention eliminates any question as to the round of scoring completed to a given point.

U.S. Pat. No. 5,126,717 issued to John C. Renaud et al. on Jun. 30, 1992 discloses an Electronic Cribbage Board having a series of lights along two immediately adjacent scoring paths or tracks to indicate the score. Scores are entered by two opposite keypads. The non-standard scoring track or path, along with the keypad entry of scores, is likely to confuse older players used to more traditional cribbage boards, and the immediately adjacent scoring paths could cause some difficulty in easily determining the score for players of less than optimum visual acuity. The present invention provides compensation for the various handicaps generally associated with aging, yet in a traditional arrangement.

U.S. Pat. No. Des. 138,400 issued to Loyal F. Roh on Aug. 1, 1944 discloses a design for a Cribbage Board having six immediately adjacent scoring paths or, tracks of 40 positions each. Thus, each player must travel three of the 40 position rows to reach the end of the game. The six immediately adjacent rows appear likely to cause some difficulty for players having less than optimum visual acuity and motor skills, due to the close proximity of the scoring pegs to one another on the immediately adjacent rows. Moreover, while the Roh board provides a "skunk" line or position to indicate a severely one sided game the position appears to be only ten spaces from the standard 120 point end of the game, rather than the traditional 30 point difference of one row or track of the traditional cribbage board. Again, the present board provides a traditional layout while also providing for ease of scoring and determination of score for the elderly and/or impaired.

U.S. Patent No. Des. 238,957 issued to Chester H. Johnson on Feb. 24, 1976 discloses a design for a Cribbage Board having two rows of 30 positions each for each player. The resulting scoring path must be completed twice to complete the game, resulting in some possible confusion over the number of laps completed for some persons. Again, the peg rows are immediately adjacent one another, with no divisions therebetween. Four different groups of five peg position holes are differently marked, but do not have any relationship to standard cribbage scoring.

U.S. Pat. No. Des. 285,539 issued to Stanley J. Fudro on Sep. 9, 1986 discloses a design for a Cribbage Board in which the opponents' scoring paths are separated, but each of which paths comprises two closely spaced peg scoring rows, unlike the present invention. The paths must be traveled twice to complete the standard scoring of the game, again unlike the present board.

British Patent Application No. 2,173,406A to Kenneth C. Armstrong and published on Oct. 15, 1986 discloses an Electronic Cribbage Board similar to the electronic cribbage board of Renaud et al. discussed above. The scoring entry keypad of Armstrong is somewhat more complex to use than the Renaud et al. keypad, however, which renders the Armstrong device even less suitable for use in the environment of the present invention.

Finally, British Patent Application No. 2,201,896A to Daniel V. Blais and published on Sep. 14, 1988 discloses Cribbage Boards having three continuous scoring paths of 120 positions each. The paths are immediately adjacent one another, thus providing some potential difficulty for some players, and the non-standard length of each path could cause some difficulty in determining relative positions at a glance, particularly for "skunk" situations.

None of the above noted patents, taken either singly or in combination, are seen to disclose the specific arrangement of concepts disclosed by the present invention.

SUMMARY OF THE INVENTION

By the present invention, an improved cribbage game apparatus is disclosed.

Accordingly, one of the objects of the present invention is to provide an improved cribbage board which is larger than standard and which provides separated single scoring paths and other advantages to assist the aged and/or impaired in the scoring of the game of cribbage.

Another of the objects of the present invention is to provide an improved cribbage board which is foldable to reduce storage space, and which includes separate internal storage space for scoring pegs and at least one card deck when the board is folded.

Yet another of the objects of the present invention is to provide improved scoring pegs which are distinct in shape and/or color for each player of the game.

Still another of the objects of the present invention is to provide improved pegs which are longitudinally symmetrical, thereby providing further ease of manipulation by the players.

An additional object of the present invention is to provide an improved game apparatus in which the board holes and corresponding pegs for each player are specifically shaped to cooperate.

A further object of the present invention is to provide an improved cribbage game apparatus which combines and utilizes the game board and pegs of the above objects.

A final object of the present invention is to provide an improved cribbage game apparatus for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
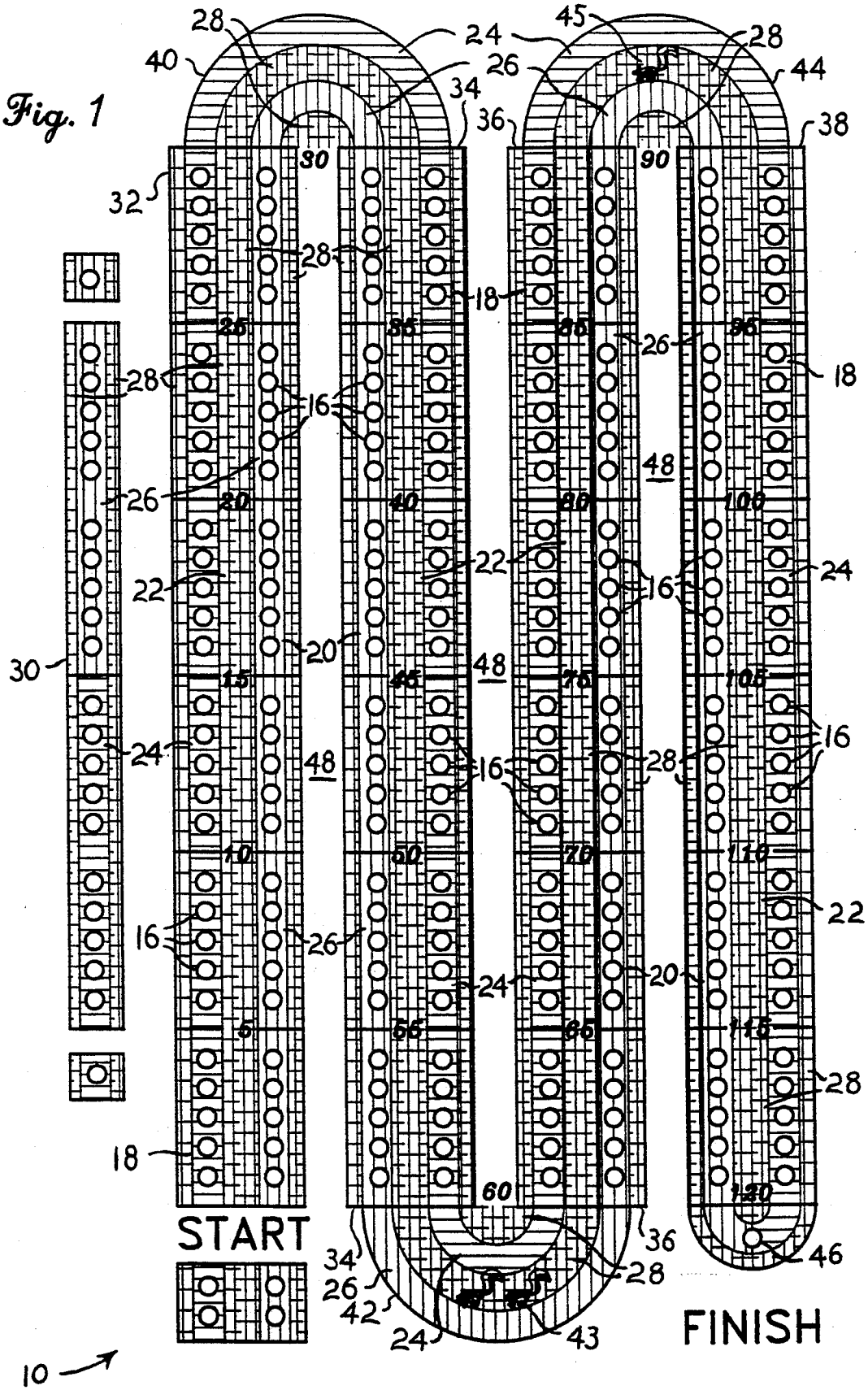
FIG. 1 is a plan view of the cribbage scoreboard of the present invention, showing the spaced apart pegging tracks for each player and the single pegging path as well as other features.
Figure 3B:
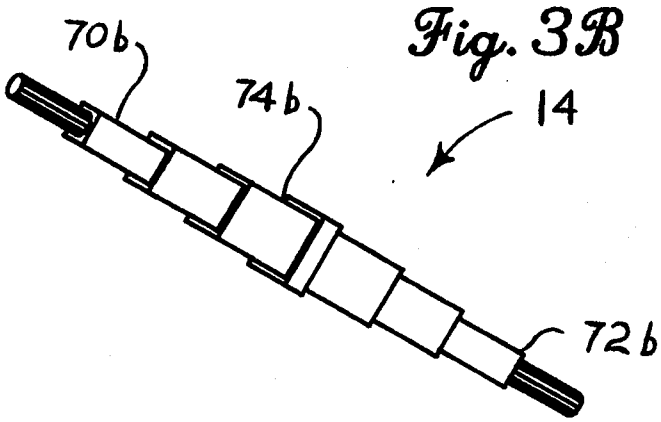
FIG. 3B is a perspective view of a second type of scoring peg.

Referring now to the drawings, the present invention will be seen to relate to a cribbage game apparatus comprising a cribbage board 10 (the layout of which is shown in FIG. 1) and cribbage scoring pegs 12 (FIG. 3A) and 14 (FIG. 3B). The board 10 layout of FIG. 1 will be seen to comprise a total of 120 scoring peg holes 16 arranged in two separate linear scoring paths 18 and 20, separated by a linear space 22 between the two scoring paths 18 and 20 providing for the relatively wide separation of the two scoring paths 18 and 20. (Additional scoring paths and spaces therebetween, not shown, may be provided for cribbage games involving more than two players, if desired.)

Figure 3A:
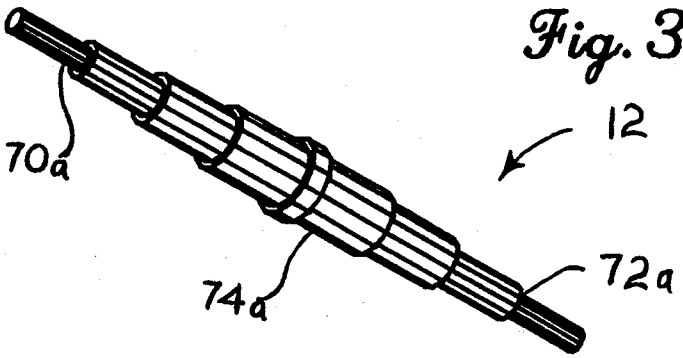
FIG. 3A is a perspective view of one type of scoring peg.

Each of the scoring paths 18 and 20 is provided with means providing for differentiation between the two paths, such as the blue color or shading 24 of the first scoring path 18 and the red color or shading 26 of the second scoring path 20. The scoring pegs 12 and 14 respectively of FIGS. 3A and 3B are preferably colored in a like manner, so as to match the colors of the scoring paths 18 and 20. The linear space 22 between the two scoring paths 18 and 20 is preferably provided with means to distinguish it from either of the two playing paths 18 and 20, e.g., a different color, such as the yellow color or shading 28 shown in FIG. 1. Other colors, shades, textures, etc. may be used as desired, so long as clear distinction is apparent between the plural playing paths of the board 10. The board may also include a separate track 30 for recording the number of games won in a series, with one portion thereof having shading or color 24 corresponding to that of the first scoring path 18, and another portion thereof having shading-/color 26 matching that of the second scoring path 20.

Each of the plural scoring paths 18 and 20 and their respective separating space 22 between the two is divided into first through fourth segments 32 through 38, with the first and second segments 32 and 34 being connected by a first arcuate interconnecting pathway 40, the second and third segments 34 and 36 connected by a second arcuate interconnecting pathway 42, and the third and fourth segments 36 and 38 connected by a third arcuate interconnecting pathway 44. The colors or markings 24 through 28 of the scoring paths 18 and 20 and the separating lane 22 therebetween, will be seen to be carried over onto the three interconnecting pathways 40 through 44 for greater clarity for the players. Gaps 48 are provided between the first and second segments 32 and 34, second and third segments 34 and 36, and third and fourth segments 34 and 36, in order to separate further the playing paths of the present board 10 for further ease of use.

It will be noted that the arcuate interconnecting pathways 40 through 44 are devoid of any scoring peg holes, in order to eliminate any confusion in the pegging or scoring count of the game; the 121 points needed to win a game are divided into the 30 peg holes for each player in each of the straight scoring path segments 32 through 38, plus the finishing hole 46. This simplifies the scoring for the players, in that the traditional game comprises 120 scoring points to the finish, with the typical game board comprising two runs of 30 pegging holes each for each player, requiring two rounds of the board to finish the game. Thus, players using the present board 10 are not required to consider pegging lanes or segments having different lengths than those of a standard board, but need only complete one circuit of a playing path in order to complete the required 120 points of the game.

One competitive aspect of cribbage is the possibility of winning a game by at least 30 or 60 points more than the accrued points of a competitor. In cribbage terminology, beating an opponent by more than 30 points is called a "skunk", and beating an opponent by more than 60 points is called a "double skunk".

The present board 10 denotes these points on the second and third arcuate interconnecting pathways 42 and 44, respectively connecting the second and third 30 hole per player segments 34 and 36, and the third and fourth segments 36 and 38. As the second interconnecting pathway 42 is at the midpoint of the scoring paths, only 60 scoring holes per player occur before that pathway 42, with another 60 holes remaining beyond. The third interconnecting pathway 44 lies at the and of the third segment 36, following 90 scoring holes per player, with another 30 holes per player remaining before the finishing hole 46. Thus, a player failing to round the second intercon netting pathway 42 before his/her opponent wins, has been "double skunked", losing by at least 60 points, while a player failing to round the third interconnecting pathway 44 before his/her opponent wins, has been "skunked" and loses by at least 30 points. Accordingly, the third arcuate interconnecting pathway 44 is provided width means 45 denoting a "skunk" game, while the second pathway 42 is provided with a "double skunk" indication 43. These "skunk" and "double skunk" locations at the ends of the second and third second and third segments, are easily recognizable, as they are not located at some intermediate point along one or another of the scoring paths, as in some other boards.

Figure 2:
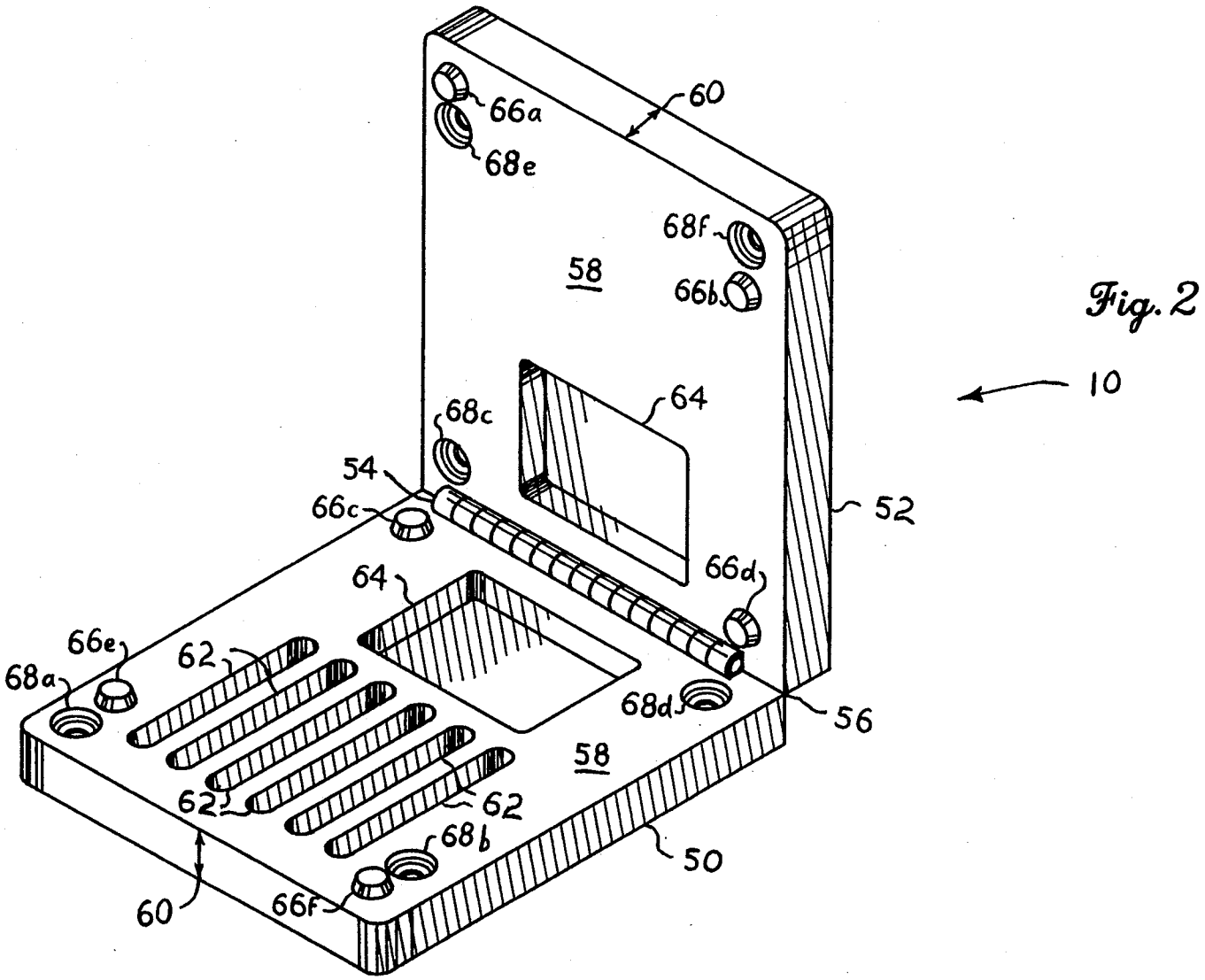
FIG. 2 is a perspective view of the bottom of the board in a partially folded state, showing the peg and card storage areas and support pad arrangement.

FIG. 2 provides a perspective view of the back of the board 10 in a partially folded configuration. The board 10 will be seen to be divided into two substantially equal halves 50 and 52 with a hinge 54 at the midline joint 56 between the two halves 50 and 52. The board 10 is configured so that the back surface 58 (the surface opposite the playing surface shown in FIG. 1) folds together, with the playing surface disposed to the outside of the board 10 when folded.

The board 10 is preferably formed with a thickness 60 sufficient to provide a plurality of hollowed storage spaces therein when the halves 50 and 52 are folded together. Scoring peg storage space(s) 62 may be provided for the storage of the scoring pegs 12 and 14, either as separate spaces for each peg, as shown, or alternatively as a single larger space providing for the containment of the pegs 12 and 14 collectively. The arrangement shown in FIG. 2, providing for separation of the pegs 12 and 14, precludes their being scratched or marred due to contact with one another. Preferably, storage space(s) 62 is/are provided for at least six pegs 12 and 14, as normally three pegs are used by each player: Two in the alternating pegging or scoring of points along the scoring paths 18 and 20, and a third for the track 30 to maintain a record of games won during a series. In addition to the scoring peg storage area(s) 62, a card deck storage area 64 may be provided. Due to the thickness of a typical deck of cards as used in the play of the game, it may be necessary to provide complementary spaces in the bottom surface 58 of each of the halves 50 and 52 of the board, to provide sufficient total depth for the card deck storage area 64.

Board 10 may also be equipped with a plurality of pads or feet protruding from the bottom surface 58, as in the pads **66*a* through 66*f* shown. Due to the mating configuration of the back or bottom surface 58 of the two halves 50 and 52, the pads 66*a* through 66*f* are slightly staggered rather than being disposed symmetrically, and mating depressions 68*a* through 68*f* are provided, into which the pads 66*a* through 66*f* may seat when the board 10** is completely folded.

FIGS. 3A and 3B disclose perspective views of the cribbage scoring pegs 12 and 14 forming a part of the present cribbage game apparatus. The peg 12 of FIG. 3A is of a generally cylindrical configuration, having a round cross section through any portion thereof. Peg 12 will be seen to be longitudinally symmetrical, with opposite ends **70*a* and 72*a* being identical and being thinner than the relatively think central portion 74*a*. The relatively thick or wide central portion 74*a*, which may be formed as a series of cylinders of decreasing diameter from a central cylinder, serves to separate further adjacent pegs 12 which may be placed in adjacent pegging or scoring holes 16 of the board 10. The relatively narrow or thin ends 70 and 72 enable a player to grasp such ends more readily due to their relatively wide spacing from other peg ends, thus making it easier for an impaired player to manipulate the pegs 12 and/or 14 and to keep score. By making the two opposite ends 70 and 72 identical to one another, if one end is broken off or damaged, the peg 12 or 14 may be inverted so the opposite end may be used to seat within a peg hole 16. Preferably, the two pegs 12 and 14 are colored or otherwise marked to match the marking of their respective scoring paths 18 and 20, e.g., peg 12 may be colored blue to match the blue shading of scoring path 18**.

Scoring peg 14 of FIG. 3B has a somewhat similar configuration, except that the cross sectional shape is square or rectangular, rather that round. Otherwise, peg 14 will be seen to have two identical opposite ends **70*b* and 72*b*, and a relatively t thicker central portion 74*b*. The same advantages are provided by the shape and configuration of the scoring peg 14 as with the scoring peg 12 of FIG. 3A. However, the square or rectangular cross section of the balance of the peg 14 provides further tactile distinction over the generally cylindrical peg 12 of FIG. 3A, thus enabling a player to distinguish between the two types of pegs 12 and 14 for different players, more easily. It will be seen that other variations on the above pegs may be provided, e.g., having a triangular cross section, etc., if desired. Preferably, peg 14 is also colored or marked so as to match its respective scoring path, as in the case of scoring peg 12** discussed above.

Figure 4:
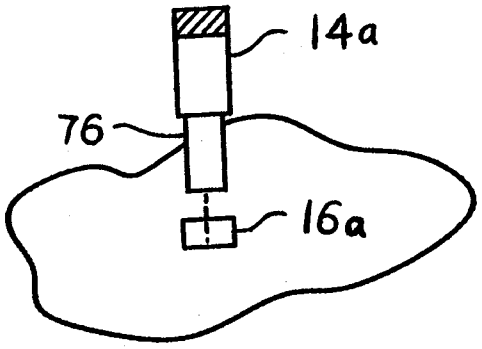
FIG. 4 is a broken away perspective showing a square section peg hole and peg extension, obviating placement of one player's peg in a second player's scoring path of the board.

FIG. 4 disclosers a means of further precluding the inadvertent placement of a peg 12 or 14 into an incorrect scoring path. A scoring peg hole **16*a* having a square or rectangular cross section may be provided for one of the scoring paths, with the peg 14*a* having a like shaped and sized peg hole insertion end 76. Thus, a square section peg hole insertion end 76 may only be inserted into a square peg hole 16*a*, and cannot fit within a round hole 16, and vice versa. Other shaped holes may be provided as needed, e.g., triangular cross section holes and peg insertion ends having congruent shapes thereto, as desired and depending upon the number of scoring paths of the board. Preferably, a round peg 12 will have a round pen insertion end to fit within a round peg hole 16, a square peg 14/14*a* will have a square peg insertion end 76 to fit within a square peg hole 16*a***, etc.

In conclusion, the present invention will be seen to provide a cribbage game apparatus having numerous advantages over earlier cribbage boards and accessories. The single scoring path of 120 peg holes for each player on a single board, requiring only a single circuit of a playing path per game, is of great assistance to players who may be suffering from short term memory impairment. The separation of the scoring paths by a space therebetween provides assistance for those who may have difficulty in handling the scoring pegs precisely, while the specific shapes of the pegs themselves are helpful in enabling players to manipulate such pegs easily and precisely as desired. The provision of four segments of the board, each having 30 pegging holes per player, and inter-connected by paths devoid of pegging holes, further assists players in the precise determination of their pegging count for a given hand or play. The "skunk" symbols are logically placed to assist players further in the determination of a potential "skunk" situation developing during the end play of the game and adjusting playing strategy accordingly. As each of the paths is colored or marked differently, and each group of scoring pegs are marked or colored to match one of the playing paths there is less likelihood of a player inadvertently manipulating another player's peg(s) by mistake. Further distinction between each group of pegs and their appropriate playing paths may be made by providing differently shaped pegging holes for each playing path, and forming the pegging hole insertion ends of each group of pegs to be congruent with a specific shape of pegging hole as provided in each playing path. Finally, the folding board, and peg and card storage means provided therein, enables the entire apparatus required for the game to be stored efficiently to reduce likelihood of loss of any components.

It is to be understood that the present invention is not limited to the sole embodiment described above, but encompasses any and all embodiments within the scope of the following claims.

I claim:

1. A cribbage game apparatus comprising:

a cribbage board consisting of a plurality of spaced apart scoring paths each having one hundred and twenty peg holes, with each of said scoring paths including a separating lane therebetween, said scoring paths divided into first through fourth segments of thirty peg holes each, said first through fourth segments of being parallel to one another;

said each of said scoring paths including means providing for differentiation from one another, and further including arcuate interconnecting pathways between each of said segments;

each of said interconnecting pathways also including said means providing for differentiation from one another and being devoid of peg holes, and;

a plurality of scoring pegs, with said pegs comprising a plurality of groups each corresponding to one of said scoring paths, with each of said groups of pegs including means providing for differentiation from one another corresponding to said means providing for differentiation of said each of said scoring paths, whereby;

said cribbage board provides for the scoring of a standard game of cribbage by the completion of a single passage of at least one of said scoring paths by corresponding said scoring pegs, with said separating lane between said each of said scoring paths, said means providing for differentiation between said scoring paths, said interconnecting pathways between said segments, and said groups of said pegs all providing for ease of determination of each of said playing paths, corresponding said pegs, and scoring situation by each of the players.

2. The cribbage game apparatus of claim 1 wherein: said cribbage board is foldable.

3. The cribbage game apparatus of claim 1 wherein: said cribbage board includes at least one card deck storage means and storage means said scoring pegs.

4. The cribbage game apparatus of claim 3 wherein: said storage means for said scoring pegs comprises a separate storage compartment for each of said scoring pegs.

5. The cribbage game apparatus of claim 1 wherein: said interconnecting pathway between said third segment and said fourth segment of said playing paths includes means defining a skunk game.

6. The cribbage game apparatus of claim 1 wherein: said interconnecting pathway between said second segment and said third segment of said playing paths includes means defining a double skunk game.

7. The cribbage game apparatus of claim 1 including: a separate scoring track providing a record of games won.

8. The cribbage game apparatus of claim 1 wherein; each of said scoring pegs is longitudinally symmetrical and includes like opposite ends with said opposite ends defining a central portion therebetween, with said central portion having a greater thickness than each of said opposite ends.

9. The cribbage game apparatus of claim 1 wherein:

each of said scoring paths includes a plurality of peg holes comprising a single group, with each of said peg holes of each said group having a similar cross sectional shape, and;

each of said scoring pegs is longitudinally symmetrical and includes like opposite ends, with said ends of said scoring pegs of each of said scoring peg groups each having a cross sectional shape corresponding to said cross sectional shape of said group of said peg holes of said corresponding one of said scoring paths, whereby;

placement of one of said scoring pegs of one of said groups of scoring pegs, into a peg hole of one of said playing paths corresponding to a different one of said groups of scoring pegs, is precluded.

10. A cribbage game board consisting of a plurality of spaced apart scoring paths each having one hundred and twenty peg holes, with each of said scoring paths including a separating lane therebetween, said scoring paths divided into first through fourth segments of thirty peg holes each, said first through fourth segments being parallel to one another;

said each of said scoring paths including means providing for differentiation from one another, and further including arcuate interconnecting pathways between each of said segments;

each of said interconnecting pathways also including said means providing for differentiation from one another and being devoid of peg holes, whereby;

said cribbage board provides for the scoring of a standard game of cribbage by the completion of a single passage of at least one of said scoring paths, with said separating lane between said each of said scoring paths, said means providing for differentiation between said scoring paths, and said interconnecting pathways between said segments all providing for ease of determination of each of said playing paths and scoring situation by each of the players.

11. The cribbage board of claim 10 wherein:

said cribbage board is foldable.

12. The cribbage board of claim 10 wherein:

said cribbage board includes at least one card deck storage means and scoring peg storage means.

13. The cribbage board of claim 12 wherein:

said scoring peg storage means comprises a plurality of separate single scoring peg storage compartments.

14. The cribbage board of claim 10 wherein:

said interconnecting pathway between said third segment and said fourth segment of said playing paths includes means defining a skunk game.

15. The cribbage board of claim 10 wherein:

said interconnecting pathway between said second segment and said third segment of said playing paths includes means defining a double skunk game.

16. The cribbage board of claim 10 including:

a separate scoring track providing a record of games won.

17. The cribbage board of claim 10 wherein:

each of said scoring paths includes a plurality of peg holes comprising a single group, with each of said peg holes of each said group having a similar cross sectional shape and each of said peg holes of each said group having a dissimilar cross sectional shape to each of said peg holes of each other said group.

* * * * *